US005517764A

United States Patent [19]

Lobb, Jr.

[11] Patent Number: 5,517,764

[45] Date of Patent: May 21, 1996

[54] CONTINUOUS CASTING MOLD CAVITY NARROW FACEPLATE TAPER GAUGE

[75] Inventor: James A. Lobb, Jr., Garden City, Mich.

[73] Assignee: Voest-Alpine Services & Technologies Corp., Pittsburgh, Pa.

[21] Appl. No.: 308,676

[22] Filed: Sep. 19, 1994

[51] Int. Cl.[6] ..... B22D 11/04; G01B 3/56

[52] U.S. Cl. ..... 33/531; 33/371; 164/436

[58] Field of Search ..... 33/531, 1 N, 333, 33/343, 365, 366, 370, 371, 379, 534, 645; 164/436, 491, 150.1

[56] References Cited

U.S. PATENT DOCUMENTS

| | | | |
|---|---|---|---|
| 1,260,126 | 3/1918 | Barker | 33/400 |
| 3,380,165 | 4/1968 | Urban | 33/534 |
| 3,564,531 | 2/1921 | Burgin | 33/333 |
| 3,869,805 | 3/1975 | Dieringer | 33/366 |
| 3,916,531 | 11/1975 | Morton | 33/333 |
| 4,171,719 | 10/1979 | Wunnenberg et al. | 164/436 |
| 4,356,860 | 11/1982 | Gladwin | 164/436 |
| 4,413,667 | 11/1983 | Schrewe et al. | 164/491 |
| 4,538,669 | 9/1985 | Markarian et al. | 33/788 |
| 4,942,668 | 7/1990 | Franklin | 33/366 |

*Primary Examiner*—William A. Cuchlinski, Jr.
*Assistant Examiner*—G. Bradley Bennett
*Attorney, Agent, or Firm*—Barnes, Kisselle, Raisch, Choate, Whittemore & Hulbert

[57] ABSTRACT

A continuous casting mold cavity narrow faceplate taper gauge that includes a mounting bracket having a first portion with abutment feet for engaging a narrow faceplate of a continuous casting mold cavity and a second portion having a surface disposed at an angle to true horizontal that varies as a function of angle of the faceplate engaged by the first portion. An inclinometer is disposed on the surface of the second portion for providing an electrical signal that varies as a function of angle of the surface to true horizontal. An electronic display is responsive to such electrical signal for indicating taper angle of the faceplate engaged by the bracket.

20 Claims, 2 Drawing Sheets

CONTINUOUS CASTING MOLD CAVITY NARROW FACEPLATE TAPER GAUGE

The present invention is directed to continuous casting mold cavities, and more particularly to a device or gauge for measuring the taper of the narrow faceplates in a continuous casting mold cavity during set-up, periodic checks and turn-around of the cavity.

BACKGROUND AND SUMMARY OF THE INVENTION

The cavity of a conventional continuous casting mold includes opposed water-cooled broad faceplates that are disposed in fixed position, and opposed water-cooled narrow faceplates positioned between the broad faceplates and coupled by shafts to motors for adjusting both the width of the cavity and angle of taper of the cavity during operation of the mold. During set-up of the mold cavity, it is necessary to measure and/or adjust the initial or home position of each of the narrow faceplates. This function is currently accomplished employing a mechanical arrangement having manual adjustment knobs, a sight glass for determining when the reference position of the device is vertical, and one or more dial indicators for measuring taper angle. The device is difficult to manipulate, and is characterized by substantially less than desired accuracy.

It is a general object of the present invention to provide a gauge for measuring narrow faceplate taper in a continuous casting mold cavity that is economical to fabricate, that is easy to use by relatively unskilled personnel, and that provides for electrical measurement and display of narrow faceplate taper. Another object of the present invention is to provide a gauge of the described character that is adapted for use in conjunction with continuous casting mold cavities of differing dimension, and/or that displays mold taper as a function of overall cavity length.

A continuous casting mold cavity narrow faceplate taper gauge in accordance with the present invention includes a mounting bracket having a first portion for engaging a narrow faceplate of a continuous casting mold cavity and a second portion having a surface disposed at an angle to true horizontal that varies as a function of angle of the faceplate engaged by the first portion. An inclinometer is disposed on the surface of the second portion for providing an electrical signal that varies as a function of angle of the surface to true horizontal. An electronic display is responsive to such electrical signal for indicating taper angle of the faceplate engaged by the bracket.

Three spaced abutment feet are mounted on the first portion of the bracket for engaging the narrow faceplate so as to place the first portion of the bracket in a plane parallel to the faceplate. The inclinometer is so disposed on the second portion of the bracket as to provide the electrical measurement signal as a function of departure from true horizontal of an axis of the inclinometer perpendicular to the plane of the abutment feet. Preferably, the inclinometer provides the measurement signal substantially independently of angle in a direction parallel to the plane of the abutment feet. A suction cup is disposed within the array of feet for releasably fastening the bracket on the narrow faceplate of the mold cavity. The suction cup is coupled to a manually operated vacuum pump, which insures that the three abutment feet are securely held against the narrow faceplate. The display electronics in the preferred embodiment of the invention displays faceplate taper as a function of total cavity length, and an operator switch is provided for inputting different cavity lengths to the display electronics.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
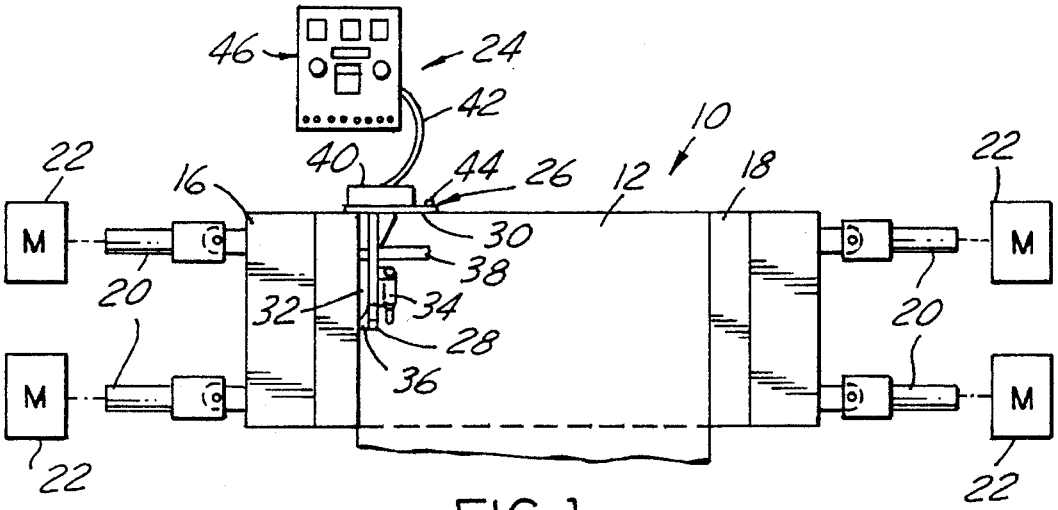
FIG. 1 is a fragmentary schematic diagram of a continuous casting mold cavity in which taper of one narrow faceplate is being measured by a gauge in accordance with a presently preferred embodiment of the invention.
Figure 2:
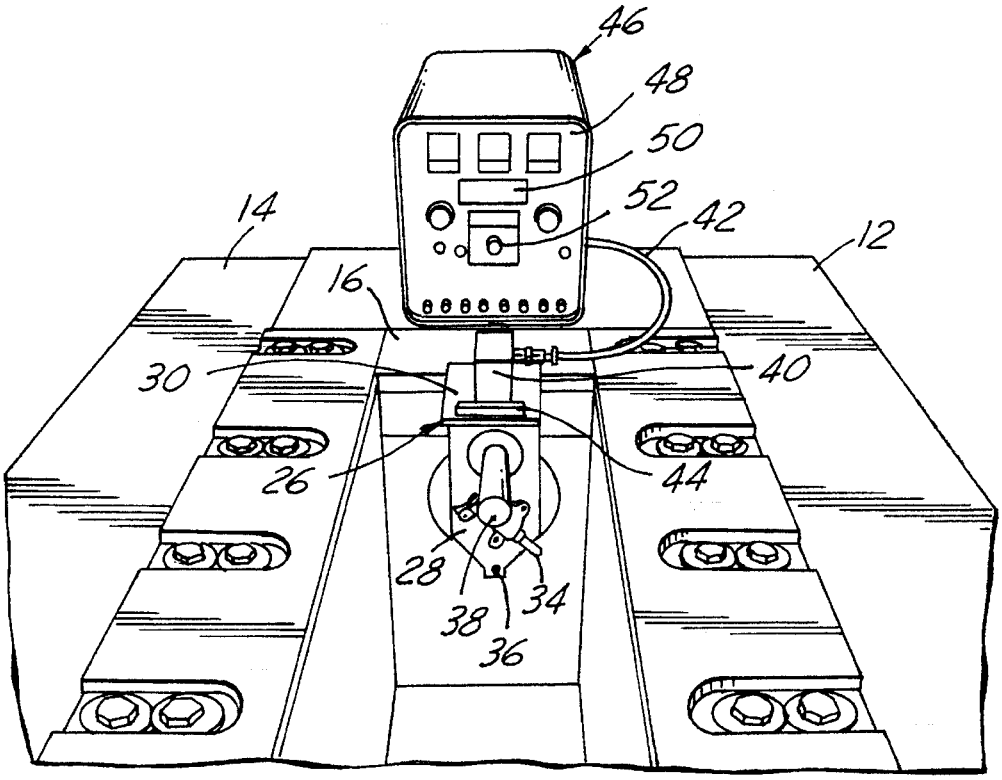
FIG. 2 is a fragmentary perspective view of the mold cavity and taper gauge in FIG. 1 on an enlarged scale.

FIGS. 1 and 2 illustrate a continuous casting mold cavity 10 having a pair of fixed opposed broad faceplates 12, 14, and a pair of opposed movable narrow faceplates 16, 18. Narrow faceplates 16, 18 are coupled by vertically spaced shafts 20 to motors 22 for adjusting both the width of cavity 10 and the angle of taper of the cavity. All of the faceplates conventionally are water cooled. It has been proposed to provide sensors coupled to one or more of the motors 22 or shafts 20 to monitor faceplate position and taper during operation of the mold cavity. The present invention is directed to a gauge 24 for measuring taper of each faceplate 16, 18 during initial set-up of the mold cavity, and thereby establishing a "home" position for further operation.

Gauge 24 in accordance with the preferred embodiment of the present invention illustrated in the drawings comprises an L-shaped bracket 26 having a first flat portion or leg 28 depending from a second flat portion or base 30. Base 30 is affixed to one edge of leg 28 so that the upper surface of base 30 is perpendicular to the plane of leg 28. A suction cup 32 is mounted on one side of leg 28, and is connected through the leg to a plunger 34 mounted on the opposing side of the leg for selectively manually activating and deactivating the suction cup. Three angularly spaced micarta abutment feet 36 are mounted on bracket leg 28 surrounding suction cup 32. A handle 38 projects from the backside of bracket leg 28 for operator manipulation of the gauge into and out of position.

Figure 3:
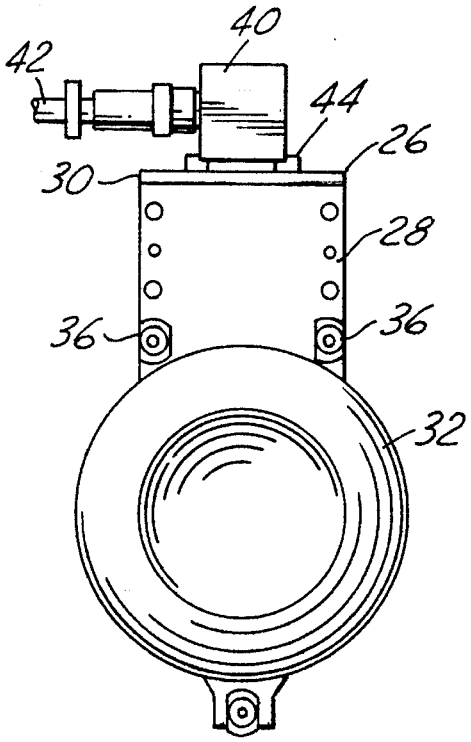
FIG. 3 is an elevational view of the gauge in accordance with the presently preferred embodiment of the invention.
Figure 4:
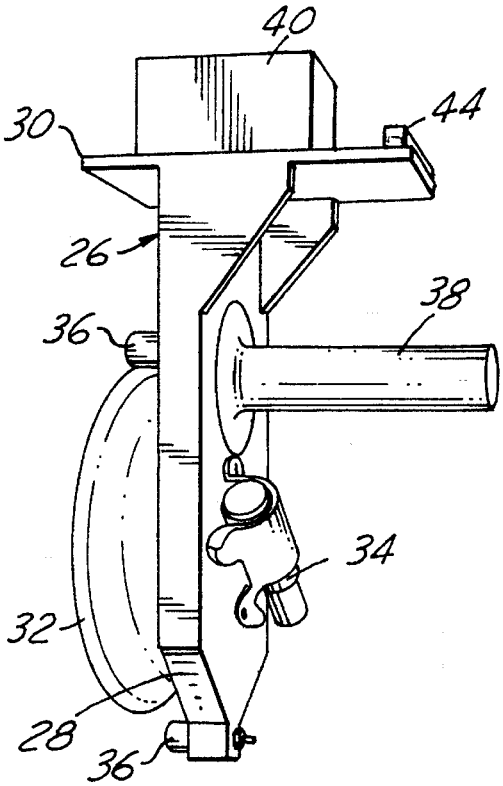
FIG. 4 is a side perspective view of the gauge illustrated in FIGS. 1–3.

An inclinometer 40 is mounted on the upper surface of base 30 at an orientation such that the inclinometer is sensitive to departure from true horizontal of an axis (into the page in FIG. 3) perpendicular to the plane of mounting feet 36 on leg 28. That is, inclinometer 40 provides an electrical signal on an output cable 42 that varies as a function of departure from true horizontal of the upper surface of bracket base 30 in a direction perpendicular to bracket leg 28, but substantially independent of angular variations in a direction parallel to the plane of bracket plate 28. In a presently preferred embodiment of the invention, inclinometer 40 comprises a variable core transformer whose magnetic coupling provides a measure of tilt in one axis. The inclinometer in a working embodiment of the invention is a Schaevite LSOC-1 degree. A spirit level 44 is mounted on the upper surface of bracket base 30, and is sensitive to inclination of base 30 in a direction parallel to the plane of leg 28.

In use, bracket 26 of gauge 24 is placed on the upper edge of a narrow faceplate 16 (or 18) with base 30 engaging the upper edge of the faceplate and abutment feet 36 engaging the plane of the faceplate. Plunger 34 is then manipulated by the operator so that suction cup 32 draws feet 36 into firm engagement with the opposing face. At this point, feet 36 cooperate with each other to define a measurement plane that is parallel to the plane of the narrow faceplate engaged by the feet, and the inclinometer mounting surface of bracket base 30 is perpendicular to such plane. Inclinometer 40 therefore provides an electrical signal as a function of faceplate angle.

Figure 5:
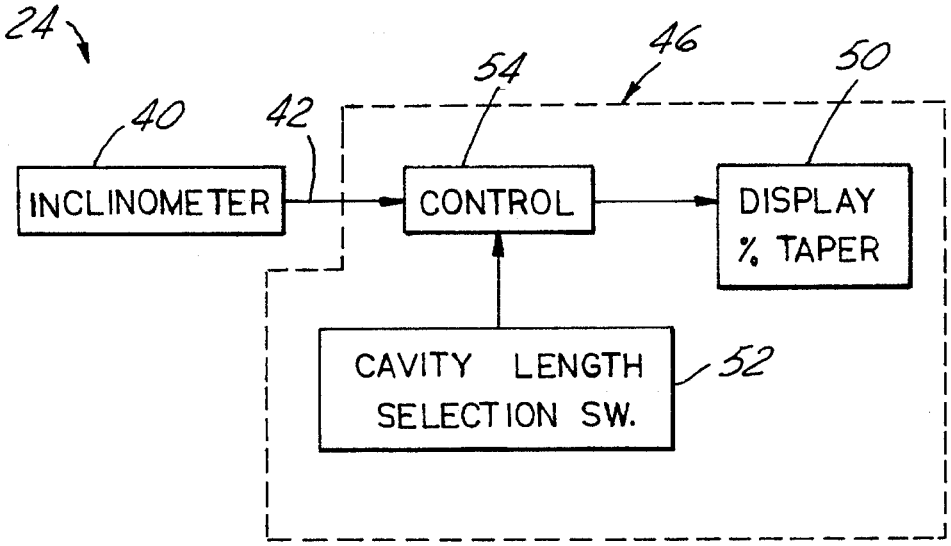
FIG. 5 is a functional block diagram of the gauge electronics.

Such electrical signal from inclinometer 40 is fed by cable 42 to an electronics enclosure or cabinet 46. Enclosure 46 has an operator panel 48 with a numeric digital display 50 and a rotary selection switch 52. At different operator selectable positions of switch 52, the switch provides to control electronics 54 (FIG. 5) within cabinet 46 a signal indicative of mold cavity length. Preferably, switch 52 is calibrated in predetermined standard cavity lengths, such as 700 mm and 900 mm. Control electronics 54 receives a signal from inclinometer 40 indicative of faceplate angle, and a signal from switch 52 indicative of total cavity length. The control electronics calculates taper at a function of total cavity length, and displays such taper at display 50. It will be recognized, of course, that control electronics 54 and display 50 could as readily provide an indication of faceplate taper angle in degrees or the like. The above process is repeated in connection with both faceplates 16, 18. The resulting information can either be loaded into a mold control computer (not shown) as the base or home set-up position of the narrow faceplates, or motors 22 can be activated by the mold control computer to adjust faceplate angle until the desired angle or taper is indicated at display 50.

I claim:

1. A continuous casting mold cavity narrow faceplate taper gauge that comprises:

a mounting bracket including first means for engaging an interior face of a narrow faceplate of a continuous casting mold cavity with means for releasably fastening said bracket to the faceplate interior face, and second means rigidly coupled to said first means and disposed at an angle to true horizontal that varies as a function of angle of the interior face engaged by said first means, an inclinometer disposed on said second means for providing an electrical signal that varies as a function of angle of said second means to true horizontal, and means responsive to said electrical signal for indicating taper of the interior face of the faceplate engaged by said first means, said first means including abutment means for engaging the faceplate interior face to place said first means in a plane parallel to the faceplate face engaged by said first means, and said second means including means for engaging an upper edge of said faceplate so as to define a reference at said second means in a direction parallel to said plane.

2. The gauge set forth in claim 1 wherein said abutment means comprises three angularly spaced abutment feet.

3. The gauge set forth in claim 1 wherein said inclinometer is so disposed on said second means as to provide said electrical signal as a function of departure from true horizontal of an axis perpendicular to said plane.

4. The gauge set forth in claim 3 wherein said inclinometer provides said electrical signal substantially independently of angle variations parallel to said plane.

5. The gauge set forth in claim 1 wherein said second means comprises means for determining angular orientation of said inclinometer in a direction parallel to said plane.

6. The gauge set forth in claim 1 wherein said releasably fastening means comprises a suction cup, including means for manually activating and releasing said suction cup.

7. The gauge set forth in claim 1 wherein said signal-responsive means includes means for displaying taper of the faceplate engaged by said first means as a function of percent of mold cavity length.

8. The gauge set forth in claim 7 wherein said signal-responsive means further includes means for providing an electrical signal as a function of mold cavity length, and means for calculating taper as a function of said signals.

9. A continuous casting mold cavity narrow faceplate taper gauge that comprises:

a mounting bracket including first means having abutment means for engaging a narrow faceplate of a continuous casting mold cavity to place said first means in a plane parallel to said faceplate, and second means rigidly coupled to said first means and disposed at an angle to true horizontal that varies as a function of angle of the faceplate engaged by said first means, said second means including means for determining angular orientation of said inclinometer in a direction parallel to said plane, an inclinometer disposed on said second means for providing an electrical signal that varies as a function of angle of said second means to true horizontal, and means responsive to said electrical signal for indicating taper of the faceplate engaged by said first means.

10. The gauge set forth in claim 9 wherein means for determining angular orientation comprise a spirit level.

11. A continuous casting mold cavity narrow faceplate taper gauge that comprises:

a mounting bracket including first means for engaging a narrow faceplate of a continuous casting mold cavity, and second means rigidly coupled to said first means and disposed at an angle to true horizontal that varies as a function of angle of the faceplate engaged by said first means, an inclinometer disposed on said second means for providing an electrical signal that varies as a function of angle of said second means to true horizontal, and means responsive to said electrical signal for indicating taper of the faceplate engaged by said first means, including means for providing an electrical signal as a function of mold cavity length, means for calculating taper as a function of said signals, and means for displaying taper of the faceplate engaged by said first means as a function of percent of mold cavity length.

12. The gauge set forth in claim 11 wherein said means for providing said signal as a function of mold cavity length comprises switch means responsive to an operator for selectively inputting signals to said calculating means indicative of different cavity lengths.

13. A continuous casting mold cavity narrow faceplate taper gauge that comprises:

a mounting bracket having a first portion with a suction cup for releasably mounting said bracket on a narrow faceplate of a continuous casting mold cavity and three angularly spaced abutment feet surrounding said suction cup for engaging the narrow faceplate so as to place said first means in a plane parallel to said faceplate, and a second portion having a surface perpendicular to the plane of said abutment feet, an inclinometer disposed on said surface of said second portion and oriented so as to provide an electrical signal that varies as a function of angle of said surface from true horizontal, and means responsive to said electrical signal for displaying taper of the faceplate engaged by said abutment feet.

14. The gauge set forth in claim 13 wherein said displaying means displays faceplate taper as a function of percent of mold cavity length.

15. The gauge set forth in claim 14 wherein said signal-responsive means further includes means for providing an electrical signal as a function of mold cavity length, and means for calculating taper as a function of said signals.

16. The gauge set forth in claim 15 wherein said means for providing said signal as a function of mold cavity length comprises switch means responsive to an operator for selectively inputting signals to said calculating means indicative of different cavity lengths.

17. The gauge set forth in claim 13 wherein said suction cup includes means for manually actuating and releasing said suction cup.

18. The gauge set forth in claim 17 further including a handle coupled to said first portion of said bracket for manipulating said bracket into engagement with the faceplate.

19. A continuous casting mold cavity narrow faceplate taper gauge that comprises:

a mounting bracket including first means having three angularly spaced abutment feet for engaging an interior face of a narrow faceplate of a continuous casting mold cavity to place said first means in a plane parallel to said faceplate, and second means rigidly coupled to said first means and disposed at an angle to true horizontal that varies as a function of angle of the faceplate engaged by said first means, an inclinometer disposed on said second means for providing an electrical signal that varies as a function of angle of said second means to true horizontal, and means responsive to said electrical signal for indicating taper of the faceplate engaged by said first means.

20. A continuous casting mold cavity narrow faceplate taper gauge that comprises:

a mounting bracket including first means for engaging a narrow faceplate of a continuous casting mold cavity, said first means including a suction cup and means for manually activating and releasing said suction cup for releasably fastening said bracket to the faceplate, and second means rigidly coupled to said first means and disposed at an angle to true horizontal that varies as a function of angle of the faceplate engaged by said first means, an inclinometer disposed on said second means for providing an electrical signal that varies as a function of angle of said second means to true horizontal, and means responsive to said electrical signal for indicating taper of the faceplate engaged by said first means.

* * * * *